United States Patent [19]

Cole

[11] Patent Number: 4,923,048

[45] Date of Patent: May 8, 1990

[54] SAFETY RESTRAINT DEVICE

[75] Inventor: Barry A. Cole, Colchester, Conn.

[73] Assignee: Sinco, Inc., East Hampton, Conn.

[21] Appl. No.: 389,752

[22] Filed: Aug. 4, 1989

[51] Int. Cl.[5] ..... A62B 35/00

[52] U.S. Cl. ..... 182/9

[58] Field of Search ..... 182/3–9

[56] References Cited

U.S. PATENT DOCUMENTS 548,076 10/1895 Mack ..... 182/9

1,504,030 8/1924 Dettweiler ..... 182/9

1,721,516 7/1929 Jacobs ..... 182/9

1,802,288 4/1931 Strauss ..... 182/9

*Primary Examiner*—Reinaldo P. Machado

*Attorney, Agent, or Firm*—Chilton, Alix & Van Kirk

[57] ABSTRACT

A safety restraint device, such as worn by a worker for preventing falls, employs a sliding D-shaped ring which is mounted to the safety lanyard. The releasable snap hook of the safety lanyard may be engaged in the sliding D-ring to secure the safety lanyard to a fixed object.

12 Claims, 2 Drawing Sheets

SAFETY RESTRAINT DEVICE

BACKGROUND OF THE INVENTION

This invention relates generally to body belts, harnesses, and the like which are worn by workers to prevent falls. More particularly, the present invention relates to safety devices having one or more lanyards which connect or tie off with a fixed object.

In hazardous occupations and work conditions, body belts and body harnesses have long been employed by workers to reduce the potential for serious falls. Such body belts and body harnesses come in a wide variety of styles, types and configurations. Conventionally, a safety belt is secured around the waist of the worker. A lanyard connects to the safety belt for securement around a fixed object. A number of conventional body belts to which the invention relates, employ generally D-shaped pivotal ring members which are connected to the belt wrapped around the worker's waist. The lanyard is then connected between the pivotal D-ring members. Releasable snap hooks which employ a releasable keeper securable in a locked position, are attached at the ends of the lanyard and are engageable with the D-ring member for connecting the lanyard back into the body belt.

Despite a number of designed safety features of conventional body belts, the connection of the lanyard to the body belt is not always feasible or desirable. Connecting to other than a D-ring may present a potential for accidental disengagement. Under certain unusual and intense load conditions, it is possible that conventional lanyards connected to other than a D-ring may encounter a "roll-out" condition due to the positioning of the lanyard line over the snap hook safety mechanism. While "roll-out" conditions are quite infrequent and can be prevented by the worker observing certain safety precautions, the consequences of an actual "roll-out" condition are potentially life threatening.

SUMMARY OF THE INVENTION

Briefly stated, the invention, in a preferred form, is a safety restraint device which employs a safety belt for attachment around the waist of an individual. A safety lanyard connects with the safety belt. The safety lanyard includes a flexible cable or rope for attachment to a fixed object. A snap hook, including a releasable safety keeper, is attached at the end of the cable for securing the lanyard. A sliding ring is mounted to the lanyard for slidable positioning along the cable. The ring comprises a connector sleeve which defines a longitudinal channel for slidably receiving the cable. A generally D-shaped ring extends from the connector sleeve. The ring is dimensioned so that the hook may be attached to the D-ring, but that the likelihood of roll out is minimized. The lanyard is wrappable around the fixed secure object and the hook is engageable with the D-ring to secure the lanyard to the fixed object.

The connector sleeve includes enlarged tapered end portions so that the ends of the connector sleeve do not overly strain the lanyard cable during a fall or other loading conditions. The channel wall portions of the sleeve are also finished to alleviate undue abrasion between the lanyard cable and the connector sleeve.

An object of the invention is to provide a new and improved safety restraint device.

Another object of the invention is to provide a new and improved mechanism for securing a safety restraint device lanyard around a fixed object.

A further object of the invention is to provide a new and improved safety restraint device which minimizes "roll-out" of the connector hook of the lanyard.

A yet further object of the invention is to provide a new and improved safety restraint device having an extended range of "tie off" positions and allowing for increased worker mobility by reducing the need to have the lanyard connected back to the belt mounted D-ring.

Other objects and advantages of the invention will become apparent from the drawings and the specification.

DETAILED DESCRIPTION OF THE INVENTION

Figure 1:
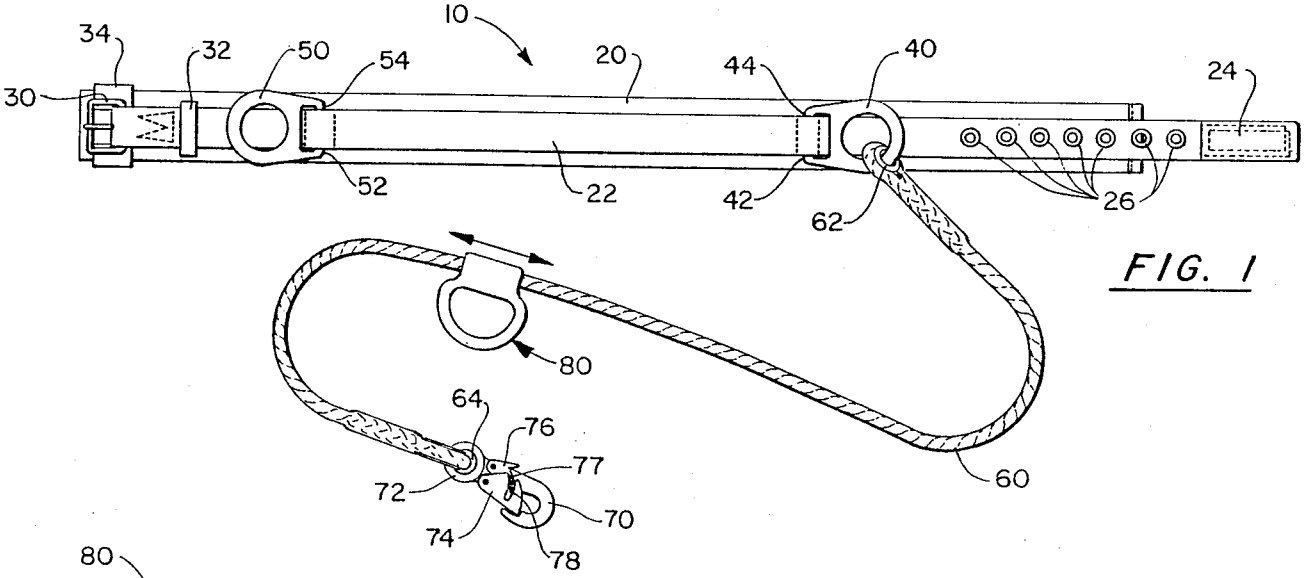
FIG. 1 is a side view of an elongated unsecured configuration of safety restraint device in accordance with the present invention.

With reference to the drawings wherein like numerals represent like parts throughout the figures, a safety restraint device incorporating the improvement of the present invention is designated generally by the numeral 10. Safety restraint device 10 comprises a belt 20 which is secured around the waist of an individual. The safety device is connected and/or tied off to a fixed object 100 (schematically illustrated) to prevent the wearer from accidentally falling or to greatly limit any free fall should the wearer accidentally slip. The invention has applicability in connection with a wide variety of safety body belts, harnesses, and the like. It should be appreciated that the specific body belt 10 of FIG. 1 is illustrated for purposes of describing the invention and is not a limitation of the applicability or the scope of the improvement of the present invention.

Safety belt 12 includes a rugged reinforced inner belt 20 which is formed of heavy-duty woven, multi-ply webbing material. An outer narrower webbing strip 22 connects with the inner belt and extends circumferentially therewith in overlapping relationship. The outer strip 22 is securely stitched to the inner webbing of the inner belt 20 along the back portion thereof. A leather lining 24 is stitched at the inner surface of the outer webbing strip 22 and wrapped around one end portion thereof and stitched in place. A co-linear series of openings 26 extend through the outer webbing strip 22 and the leather lining 24. Brass rivets may be stamped into the openings. The opposing end of the webbing strip 22 secures a belt buckle 30 of heavy-duty form which is engageable in a selected opening 26. A belt loop 32 is also secured by the outer webbing. A forward interiorly projecting leather loop 34 is dimensioned to receive the inner belt 20 so that the inner belt extends therethrough and the webbing strip may be buckled in a conventional manner.

A pair of heavy-duty metal D-shaped ring members 40 and 50 are mounted for pivotal positioning at spaced positions along the body belt. The D-ring members include respective connector shafts 42 and 52 which extend in generally perpendicular relationship to the longitudinal axis of the body belt. Cylindrical wear pads 44 and 54 are wrapped around the shafts. The webbing strip 22 is secured to the inner belt 20 to for loops which connect the D-rings to the body belt.

A safety lanyard 60, which may be either a steel cable or a cable having a fibrous rope-like composition, is wrapped around D-ring member 40 and spliced in place. A thimble 62 is preferably interposed around the D-ring member at the inside of the splice loop for preventing excessive abrasion which would tend to fray or weaken the fibers or wires. It should be appreciated that the D-ring members 40 and 50 are freely pivotal and have an orientation which is perpendicular to the longitudinal axis of the safety belt.

The free end of the lanyard 60 connects with a hook 70 through a ring 72. The lanyard is spliced around a thimble 64 which loops the ring 72. The thimble 64 also functions to prevent excessive abrasion of the metal ring against the lanyard cable. A spring-loaded keeper 74 is biased to enclose the eye of the hook. A release lever 76 is also mounted to the hook. The release lever 76 includes a projecting tab 77 which interferes with the keeper to prevent release of the keeper. The lever is manually depressible so that the tab 77 passes through a slot 78 of the keeper for releasing the keeper from the safety closed position. The hook 70 may be engaged by forcing the D-ring member 50 into the eye of the hook against the bias of the keeper. The keeper then biases to the closed position and the release latch is biased to pivot to prevent release of the keeper.

Figure 3:
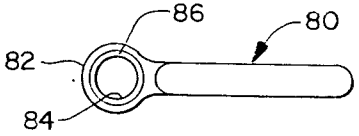
FIG. 3 is a top plan view of the D-ring connector of FIG. 2.
Figure 2:
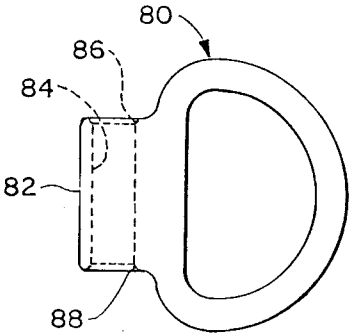
FIG. 2 is an enlarged side elevational view, partly in phantom, of a sliding D-ring connector employed in the safety restraint device of FIG. 1.
Figure 4:
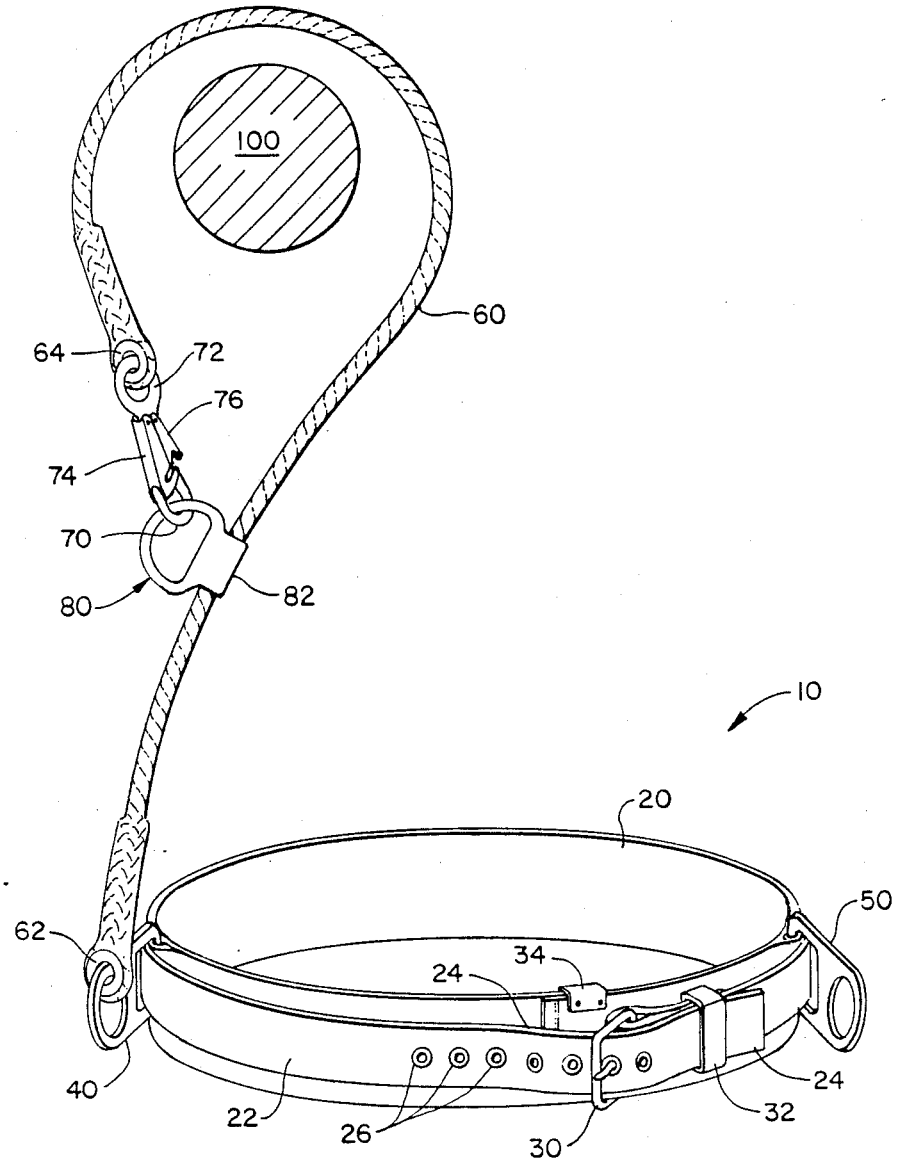
FIG. 4 is a perspective view of the safety restraint device of FIG. 1 illustrated in a selected operable mode.

With additional reference to FIGS. 3 and 4, a sliding generally D-shaped ring 80 includes an integral connector sleeve 82 which defines a longitudinal channel 84. The D-ring is made of a rugged metal material such as steel. The end portions of the channel have flared tapered openings 86 and 88. The channel is generally uniformly dimensioned so that the lanyard cable may be slidably extended therethrough for mounting the D-ring 80 to the lanyard 60. The flared openings 86 and 88 prevent cable fraying and excessive abrasive forces against the lanyard cable. In addition, the inner portion of the channel has a smooth finish to prevent undue frictional abrasion against the freely slidable lanyard cable.

The sliding D-ring 80 is dimensioned so that the hook 70 is engageable therewith and the keeper 74 locks the hook to the sliding D-ring. In one mode of the invention, the safety restraint device is mounted to the wearer by securing the safety belt 12 in place. With reference to FIG. 4, the lanyard 60 is then wrapped around a fixed object 100 (which ordinarily should be capable of supporting a dead weight of 5,400 pounds) and is secured back to the lanyard through the sliding D-ring 80. The sliding D-ring functions in a fashion which prevents the "roll-out" condition where the lanyard cable engages the snap hook as may occur under certain unusual conditions with the conventional tying back of the lanyard to D-ring member 50 or other connector.

The lanyard cable is preferably relatively short, such as on the order of a few feet, so that should a wearer accidentally fall, the free fall will be limited. For some applications, it may not be possible to connect the hook 70 with the sliding D ring 80. In the latter case, the hook is connected in a conventional fashion to the fixed pivotal D-ring member 50. The sliding D-ring 80 is then simply left in a free condition. It should be appreciated that the sliding D-ring 80 and the hook 70 are configured so that the safety snap hook does not disengage without manual release and disengagement. The lanyard may also be configured to have a hook 70 on both ends with one hook connecting D-ring member 40.

In some embodiments an O-shaped or quasi O-shaped ring or rings may be employed rather than the described D-shaped rings.

While a preferred embodiment of the invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety restraint device comprising:

safety belt means for attachment around the waist of an individual;

safety lanyard means connected to said safety belt means for attachment to a fixed object, said lanyard means comprising:

a cable having a free end;

snap hook means connected to said cable at said free end comprising a hook having a releasable safety keeper for securing said lanyard means;

slidable ring means mounted to said cable for slidable positioning therealong, said ring means comprising a connector sleeve defining a longitudinal channel for receiving said cable and a ring integrally extending from said connector sleeve and dimensioned wherein said hook may be securely attached to said slidable ring.

so that said cable is wrappable around a fixed object and said snap hook means is engageable with said slidable ring to secure said lanyard means to said fixed object.

2. The safety restraint device of claim 1 wherein said slidable ring has a substantially D-shape.

3. The safety restraint device of claim 1 wherein said connector sleeve further defines flared openings at the end portions of said channel.

4. The safety restraint device of claim wherein said channel has a generally cylindrical configuration having a diameter which is slightly greater than the diameter of the lanyard cable.

5. The safety restraint device of claim 1 wherein said safety lanyard means is connected to said safety belt means by means of a second ring which is attached in a fixed orientation to said safety belt means for pivotal positioning thereabout and further comprising a third ring attached to said slidable belt means in a fixed orientation for pivotal relationship thereabout and wherein said snap hook means may be connected to said sliding ring.

6. A safety restraint device comprising:

body belt means for attachment to the body of an individual comprising a belt fastenable around the waist of the individual and at least one ring attached to said belt;

safety lanyard means connected to a said ring for attachment to a fixed object, said lanyard means comprising:

a cable connecting the said ring and having a free end;

latch hook means connected to said cable at said free end comprising a latch member for securing said lanyard means;

slidable ring means mounted to said cable for slidable positioning therealong, said ring means comprising a connector sleeve defining a longitudinal channel for receiving said cable and a generally D-shaped ring integrally extending from said connector sleeve and dimensioned wherein said latch means may be securely attached to said slidable ring.

7. The safety restraint device of claim 6 wherein said connector sleeve further defines flared openings at the end portions of said channel.

8. The safety restraint device of claim 6 wherein said channel has a generally cylindrical configuration having a diameter which is slightly greater than the diameter of the lanyard cable.

9. A safety restraint device comprising:

safety belt means for attachment to an individual comprising a belt fastenable around the waist of the individual and at least one pivotally positionable ring attached to said belt;

safety lanyard means connected to a said ring for attachment to a fixed object, said lanyard means comprising:

cable means connecting the said ring and having a free end;

snap hook means connected to said cable means comprising a hook having a manually releasable safety keeper for securing said lanyard means;

ring means mounted to said cable means, said ring means comprising a connector sleeve defining a longitudinal channel for receiving said cable means and a ring section having an arcuate portion, said ring section integrally extending from said connector sleeve and dimensioned wherein said hook means may be securably attached to said ring section.

10. The safety restraint device of claim 9 wherein said connector sleeve further defines flared openings at the end portions of said channel.

11. The safety restraint device of claim 9 wherein said channel has a generally cylindrical configuration having a diameter which is slightly greater than the diameter of the lanyard cable means.

12. The safety restraint device of claim 9 wherein said ring section has a generally D-shape.

* * * * *